US007067009B2

(12) United States Patent
Bolyard, Jr. et al.

(10) Patent No.: US 7,067,009 B2
(45) Date of Patent: Jun. 27, 2006

(54) STRAND GUIDE IMPLEMENTS OR MECHANISMS FOR USE IN CONNECTION WITH MATERIAL DISPENSING AND COATING NOZZLES

(75) Inventors: Edward W. Bolyard, Jr., Old Hickory, TN (US); Mel S. Lessley, Villa Hills, KY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/863,463

(22) Filed: Jun. 9, 2004

(65) Prior Publication Data

US 2005/0274318 A1 Dec. 15, 2005

(51) Int. Cl.
*B05C 5/00* (2006.01)
*B05C 3/12* (2006.01)
*B05B 13/02* (2006.01)

(52) U.S. Cl. ..... 118/325; 118/420; 118/305; 156/578

(58) Field of Classification Search ..... 118/305, 118/325, 234, 420, 313; 156/244.11, 500, 156/576, 578; 427/208.6, 256, 286, 422
See application file for complete search history.

(56) References Cited

U.S. PATENT DOCUMENTS 2,841,020 A 7/1958 Van Deventer, IV
2,899,339 A * 8/1959 Rakus ..... 430/631
3,125,126 A 3/1964 Engels
3,667,846 A 6/1972 Nater et al.
4,044,250 A 8/1977 Fetzer
4,215,939 A 8/1980 Miller et al.
4,458,152 A 7/1984 Bonora
4,687,477 A 8/1987 Suzuki et al.
4,750,960 A 6/1988 Bubeck
4,842,666 A 6/1989 Werenicz
4,984,440 A * 1/1991 McCall ..... 68/200
5,525,175 A 6/1996 Blenke et al.
5,660,664 A 8/1997 Herrmann (Continued)

OTHER PUBLICATIONS

Non-Woven Systems, Nordson Corporation, 1998.

(Continued)

*Primary Examiner*—Chris Fiorilla
*Assistant Examiner*—Yewebdar Tadesse
(74) *Attorney, Agent, or Firm*—Schwartz & Weinrieb

(57) ABSTRACT

A new and improved strand coating system comprises a strand guide block which serves to properly position and orient a plurality of elongated, parallel strands, which are being respectively conveyed in front of a plurality of the material dispensing nozzles, in such a manner that the plurality of elongated, parallel strands can assuredly be respectively disposed within common planes which are effectively formed between the strand guide slots defined within the strand guide block and the plurality of material dispensing nozzles whereby the dispensed hot melt adhesive materials can be properly applied to and coated upon the elongated strands prior to the adherence of the elongated strands upon suitable substrates so as to, in turn, ensure the desirably secured adherence of the plurality of elongated strands upon the particular substrates when the elongated strands and the substrates are mated together. The plurality of strand guide slots may have substantially V-shaped cross-sectional configurations or substantially L-shaped cross-sectional configurations, and the strand guide block can be mounted either upon the module assembly or the dispensing nozzle assembly so as to be disposed at elevational positions which are either vertically above or below the hot melt adhesive dispensing nozzles in order to accommodate vertically upward or vertically downward strand conveyance systems.

18 Claims, 7 Drawing Sheets

U.S. PATENT DOCUMENTS

| | | | | |
|---|---|---|---|---|
| 5,735,788 | A | 4/1998 | Yasutake et al. | |
| 5,766,411 | A | 6/1998 | Wilson | |
| 5,902,540 | A | 5/1999 | Kwok | |
| 5,964,973 | A | 10/1999 | Heath et al. | |
| 6,077,375 | A | 6/2000 | Kwok | |
| 6,200,635 | B1 | 3/2001 | Kwok | |
| 6,520,237 | B1 | 2/2003 | Bolyard, Jr. et al. | |
| 6,582,518 | B1 | 6/2003 | Riney | |
| 6,613,146 | B1 | 9/2003 | Bolyard, Jr. | |
| 2003/0200921 | A1* | 10/2003 | Crane et al. | 118/420 |

OTHER PUBLICATIONS

ITW Dynatec, Integra System.

* cited by examiner

STRAND GUIDE IMPLEMENTS OR MECHANISMS FOR USE IN CONNECTION WITH MATERIAL DISPENSING AND COATING NOZZLES

FIELD OF THE INVENTION

The present invention relates generally to strand coating systems, and more particularly to new and improved strand guide implements or mechanisms, for use in connection with material dispensing and coating nozzles, wherein the strand guide implements or mechanisms serve to properly position and orient a plurality of elongated, parallel strands, which are being respectively transported or conveyed in front of a plurality of the material dispensing and coating nozzles, in such a manner that the plurality of elongated, parallel strands can assuredly be respectively aligned in a coplanar manner with respect to the plurality of material dispensing and coating nozzles whereby the dispensed and discharged materials, such as, for example, hot melt adhesive materials, can be simultaneously dispensed and discharged from the plurality of material dispensing and coating nozzles, and properly applied to or coated upon the elongated strands prior to the adherence of the elongated strands upon suitable substrates, so as to ensure the desirably secured adherence of the plurality of elongated strands upon the particular substrates.

BACKGROUND OF THE INVENTION

Various, different material dispensing and coating systems or apparatus, for simultaneously coating a plurality of elongated, parallel strands with suitable materials, such as, for example, hot melt adhesive materials, are known. Dispensing and coating systems or apparatus, of the aforenoted type, are disclosed, for example, within U.S. Pat. No. 6,613,146 which issued on Sep. 2, 2003 to Bolyard, Jr., U.S. Pat. No. 6,520,237 which issued on Feb. 18, 2003 to Bolyard, Jr. et al., U.S. Pat. No. 6,200,635 which issued on Mar. 13, 2001 to Kwok, and U.S. Pat. No. 6,077,375 which issued on Jun. 20, 2000 to Kwok. In addition to the aforenoted patents, a similar system or apparatus is disclosed within U.S. patent application Ser. No. 10/623,294 which was filed on Jul. 18, 2003 in the name of M. Steve Lessley et al. More particularly, as disclosed within FIG. 1, which corresponds substantially to FIG. 2 of the aforenoted patent application, a strand coating system is generally indicated by the reference character 200, and it is seen that the strand coating system 200 comprises an adhesive dispensing device 210 which is fixedly mounted upon a module assembly 220. The module assembly 220 is, in turn, fixedly mounted upon a head 240, and a pair of strands 233, 235, to be coated with a suitable adhesive material discharged from a pair of nozzles or orifices defined within the adhesive dispensing device 210, are conveyed from a suitable strand supply roll, not shown, over a strand guide member or roller 230, which is adjustably mounted upon a pair of adjustable arms 236, 238 and within which a pair of strand guide grooves 232, 234 are defined, and downwardly past the nozzles or orifices defined within the adhesive dispensing device 210.

In order to ensure the fact that the strands 233, 235 are conveyed past the nozzles or orifices, defined within the adhesive dispensing device 210, in a desired manner or mode wherein the strands 233, 235 will be properly coated with the adhesive material, a pair of cylindrical, strand guide pins 250, 252 are mounted upon a mounting plate 254 which, in turn, is fixedly mounted upon the module assembly 220. More particularly, the provision, presence, or disposition of the pair of cylindrical, strand guide pins 250, 252 ensures the fact that the strands 233, 235 will be moved past, or aligned with, the nozzles or orifices, defined within the adhesive dispensing device 210, in a substantially coplanar manner or mode with respect to the nozzles or orifices defined within the adhesive dispensing device 210 such that the adhesive material, dispensed or discharged from the nozzles or orifices defined within the adhesive dispensing device 210, will in fact be properly deposited or coated upon the strands 233, 235. More particularly, it can be readily appreciated still further that in order for the aforenoted adhesive material coating operation to be properly performed in connection with the strands 233, 235, the strands 233, 235 must be disposed upon or conveyed along the internal portions of the pair of cylindrical, strand guide pins 250, 252, that is, the strands 233, 235 must be conveyed in a substantially tangential manner along those portions of the cylindrical, strand guide pins 250, 252 which effectively face, or are disposed toward, each other. If the strands 233, 235 are disposed upon or conveyed along the external portions of the pair of cylindrical, strand guide pins 250, 252, that is, those portions of the cylindrical, strand guide pins 250, 252 which effectively face, or are disposed, away from each other, then the strands 233, 235 will not be properly aligned, in the aforenoted coplanar manner or mode, with respect to the nozzles or orifices defined within the adhesive dispensing device 210.

It can be readily appreciated, however, that due to the circular symmetry defined by means of the cylindrical, strand guide pins 250, 252, the strands 233, 235 can in fact be easily or readily conveyed either in a tangential manner upon or along the internal portions of the pair of cylindrical, strand guide pins 250, 252 that effectively face, or are disposed, toward each other, or alternatively, the strands 233, 235 can likewise be easily or readily conveyed in a tangential manner along or upon the external portions of the pair of cylindrical, strand guide pins 250, 252 that effectively face, or are disposed, away from each other obviously, if the strands 233, 235 are erroneously or mistakenly routed so as to be tangentially conveyed along or upon the external portions of the pair of cylindrical, strand guide pins 250, 252 which effectively face, or are disposed, away from each other, the strands 233, 235 will not be properly aligned or disposed in the aforenoted coplanar manner or mode with respect to the nozzles or orifices defined within the adhesive dispensing device 210. Accordingly, the adhesive material, dispensed or discharged from the nozzles or orifices defined within the adhesive dispensing device 210, will not in fact be properly deposited upon the strands 233, 235 in accordance with required or desired deposition techniques or patterns. This will be quite detrimental to the overall adhesive coating process because the system must obviously be shut down while the strand routing problem is effectively corrected. In addition, those elongated strands, already having the adhesive material deposited or coated thereon in a relatively defective manner, must be discarded as waste in view of the fact that such strands cannot be readily re-routed for reprocessing because any adhesive material already deposited thereon, albeit in an improper mode or pattern, would tend to foul the overall strand coating system 200.

A need therefore exists in the art for new and improved strand guide implements or mechanisms, for use in connection with material dispensing and coating nozzles, wherein the strand guide implements or mechanisms will serve to properly position and orient a plurality of elongated, parallel strands, which are being respectively transported or conveyed in front of a plurality of the material dispensing and coating nozzles, in such a manner that the plurality of elongated, parallel strands can assuredly be respectively aligned in a coplanar manner with respect to the plurality of material dispensing and coating nozzles, whereby the dispensed and discharged materials, such as, for example, hot melt adhesive materials, can be simultaneously dispensed and discharged from the plurality of material dispensing and coating nozzles, and properly applied to or coated upon the elongated, parallel strands prior to the adherence of the elongated strands upon suitable substrates, so as to ensure the desirably secured adherence of the plurality of elongated strands upon the particular substrates when the elongated strands and the substrates are mated together so as form the completed fabricated product.

SUMMARY OF THE INVENTION

The foregoing and other objectives are achieved in accordance with the teachings and principles of the present invention through the provision of a new and improved strand coating system which comprises new and improved strand guide implements or mechanisms, for use in connection with material dispensing and coating nozzles, wherein the strand guide implements or mechanisms serve to properly position and orient a plurality of elongated, parallel strands, which are being respectively transported or conveyed in front of a plurality of the material dispensing and coating nozzles, in such a manner that the plurality of elongated, parallel strands can assuredly be respectively aligned in a coplanar manner with respect to the plurality of material dispensing and coating nozzles whereby the dispensed and discharged materials, such as, for example, hot melt adhesive materials, can be simultaneously dispensed and discharged from the plurality of material dispensing and coating nozzles, and properly applied to or coated upon the elongated strands prior to the adherence of the elongated strands upon suitable substrates, so as to ensure the desirably secured adherence of the plurality of elongated strands upon the particular substrates when the elongated strands and the substrates are mated together. In accordance with a first embodiment of the new and improved strand guide implements or mechanisms, a plurality of strand guide slots, each one having a substantially V-shaped cross-sectional configuration, are defined within the strand guide implement or mechanism such that the apex portions of the slots are disposed inwardly or internally within the strand guide implement or mechanism and are respectively disposed in a coplanar manner with respect to each one of the hot melt adhesive material dispensing nozzles. In this manner, each one of the elongated strands is, in turn, automatically aligned in a coplanar manner, as well as being accordingly laterally confined or restrained, with respect to a respective one of the hot melt adhesive material dispensing nozzles whereby the hot melt adhesive material can in fact be properly applied to or coated upon the elongated strands. This first embodiment of the new and improved strand guide implements or mechanisms is particularly useful in connection with elongated strands having, for example, circular or substantially square cross-sectional configurations.

In accordance with a second embodiment of the new and improved strand guide implements or mechanisms, a plurality of strand guide slots, each one having a substantially L-shaped cross-sectional configuration, are defined within the strand guide implement or mechanism. This second embodiment of the new and improved strand guide implements or mechanisms is particularly useful in connection with elongated strands having, for example, substantially rectangular cross-sectional configurations comprising two, oppositely disposed flat sides comprising, in effect, the long legs of the rectangles, and two, oppositely disposed ends comprising, in effect, the short legs of the rectangles. One of the oppositely disposed flat sides of each one of the elongated strands is disposed against one of the legs, comprising each one of the substantially L-shaped slots defined within the strand guide implement or mechanism, which is disposed internally within the strand guide implement or mechanism and which is aligned in a coplanar manner with respect to each one of the hot melt adhesive material dispensing nozzles, and in this manner, each one of the elongated strands is, in turn, automatically aligned in a coplanar manner, and is likewise laterally confined or restrained, with respect to a respective one of the hot melt adhesive material dispensing nozzles whereby the hot melt adhesive material can in fact be properly applied to or coated upon each one of the elongated strands.

It is further noted that in conjunction with either one of the aforenoted first and second embodiments of the strand guide implements or mechanisms, further variations of the use of such strand guide implements or mechanisms envisions the mounting of such strand guide implements or mechanisms upon different components of the strand coating system, as well as at different locations relative to the hot melt adhesive material dispensing nozzles. In this manner, the hot melt adhesive material can in fact be properly dispensed and discharged from the hot melt adhesive material dispensing nozzles, and applied to the plurality of elongated strands, regardless of the direction in which the plurality of elongated strands are being conveyed, that is, for example, either in the vertically upwardly or vertically downwardly conveyed directions.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
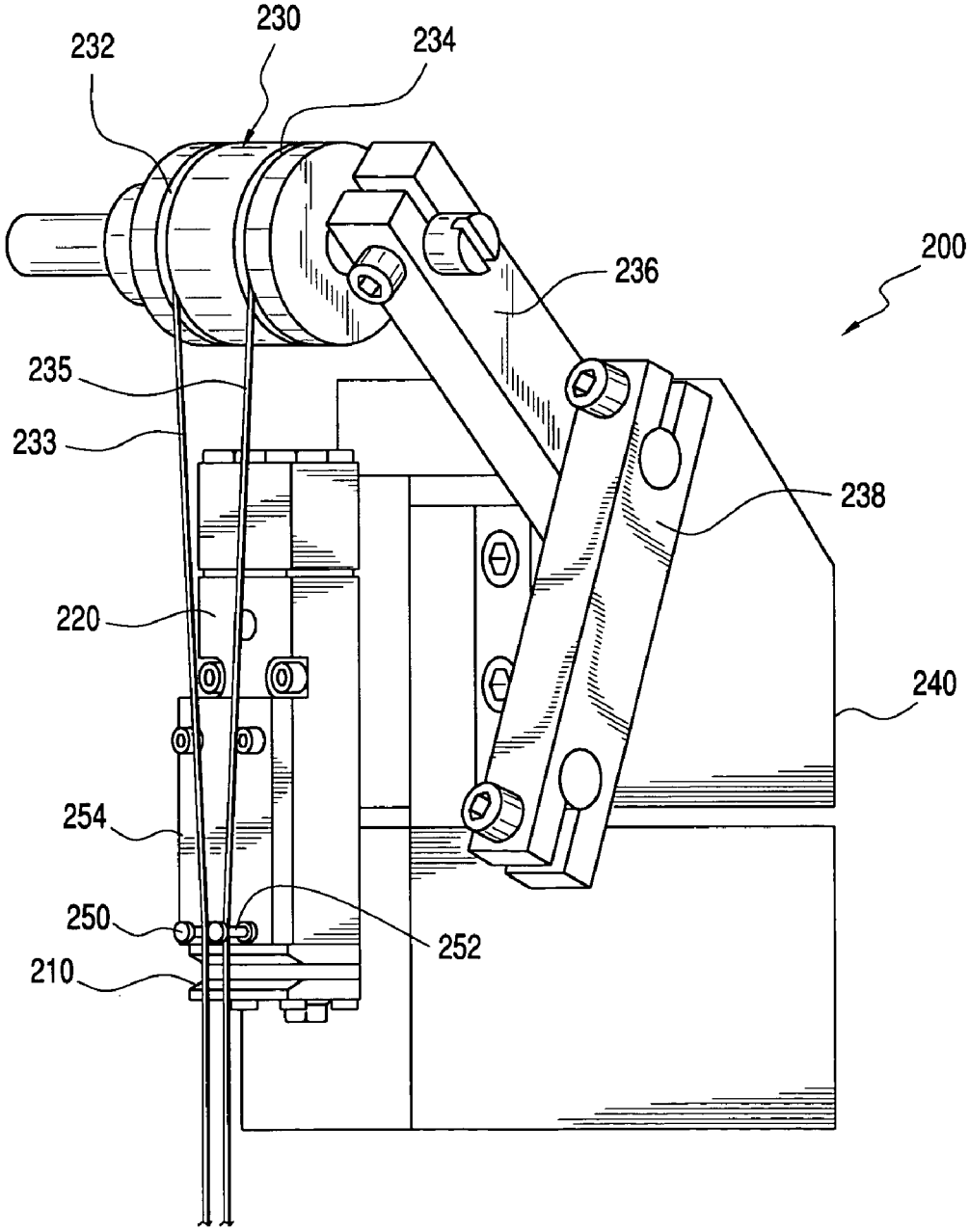
FIG.1 (PRIOR ART)
FIG. 1 is a perspective view of a conventional, PRIOR ART strand guide system that uses cylindrical, strand guide pins as the strand guide implements or mechanisms.
Figure 2:
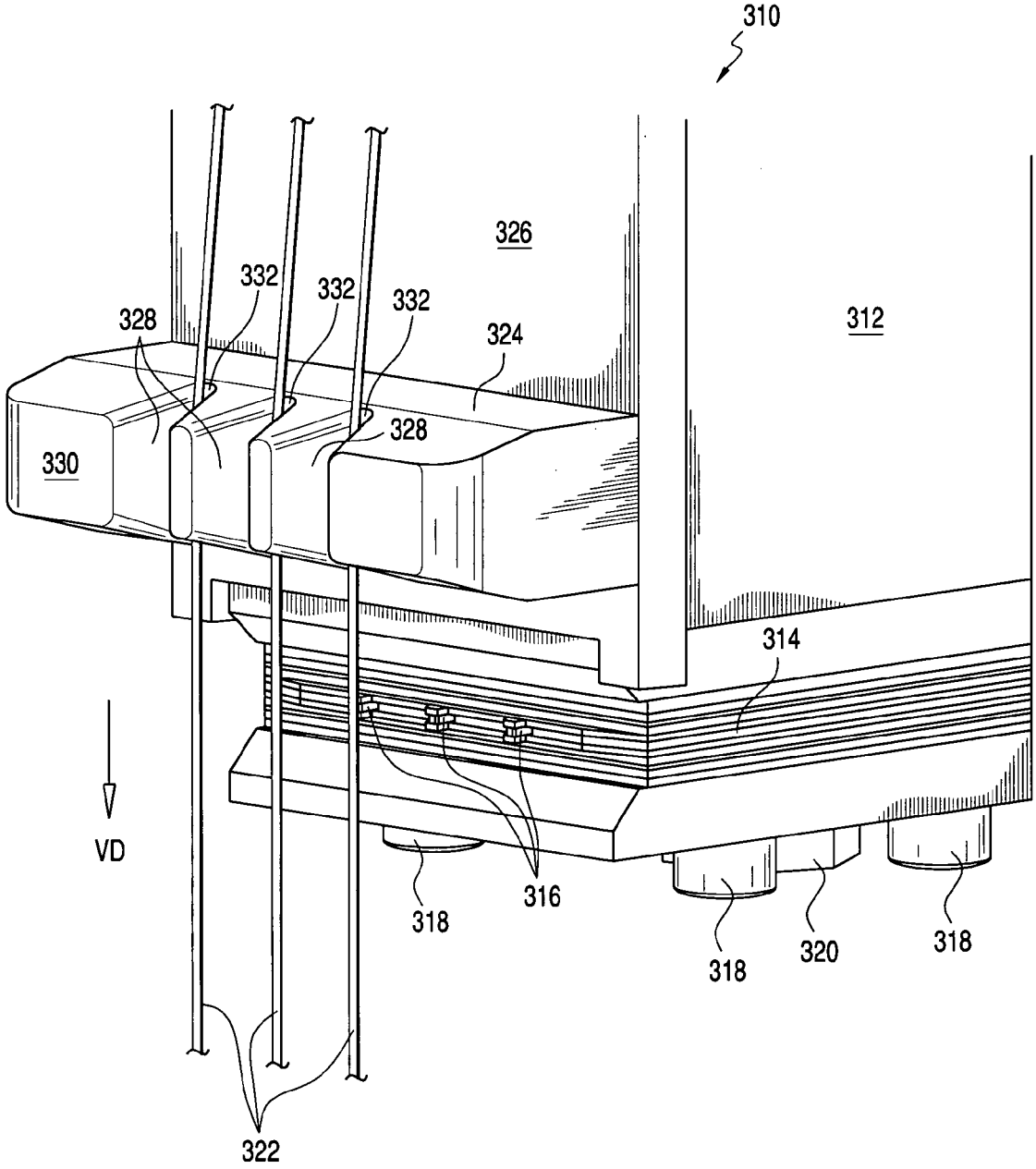
FIG. 2 is a perspective view, similar to that of FIG. 1, showing, however, a first embodiment of a new and improved strand guide system wherein a plurality of V-shaped strand guide slots are defined within a strand guide implement or mechanism which is mounted upon a mounting plate that is mounted upon the module assembly of the hot melt adhesive dispensing device or system in such a manner that the plurality of V-shaped strand guide slots are disposed at an elevational level which is vertically above that of the horizontal array of hot melt adhesive dispensing nozzles so as to effectively guide or align those portions of the plurality of elongated strands which are disposed upstream of the hot melt adhesive dispensing nozzles in view of the fact that the plurality of elongated strands are being conveyed in the vertically downward direction.
Figure 3:
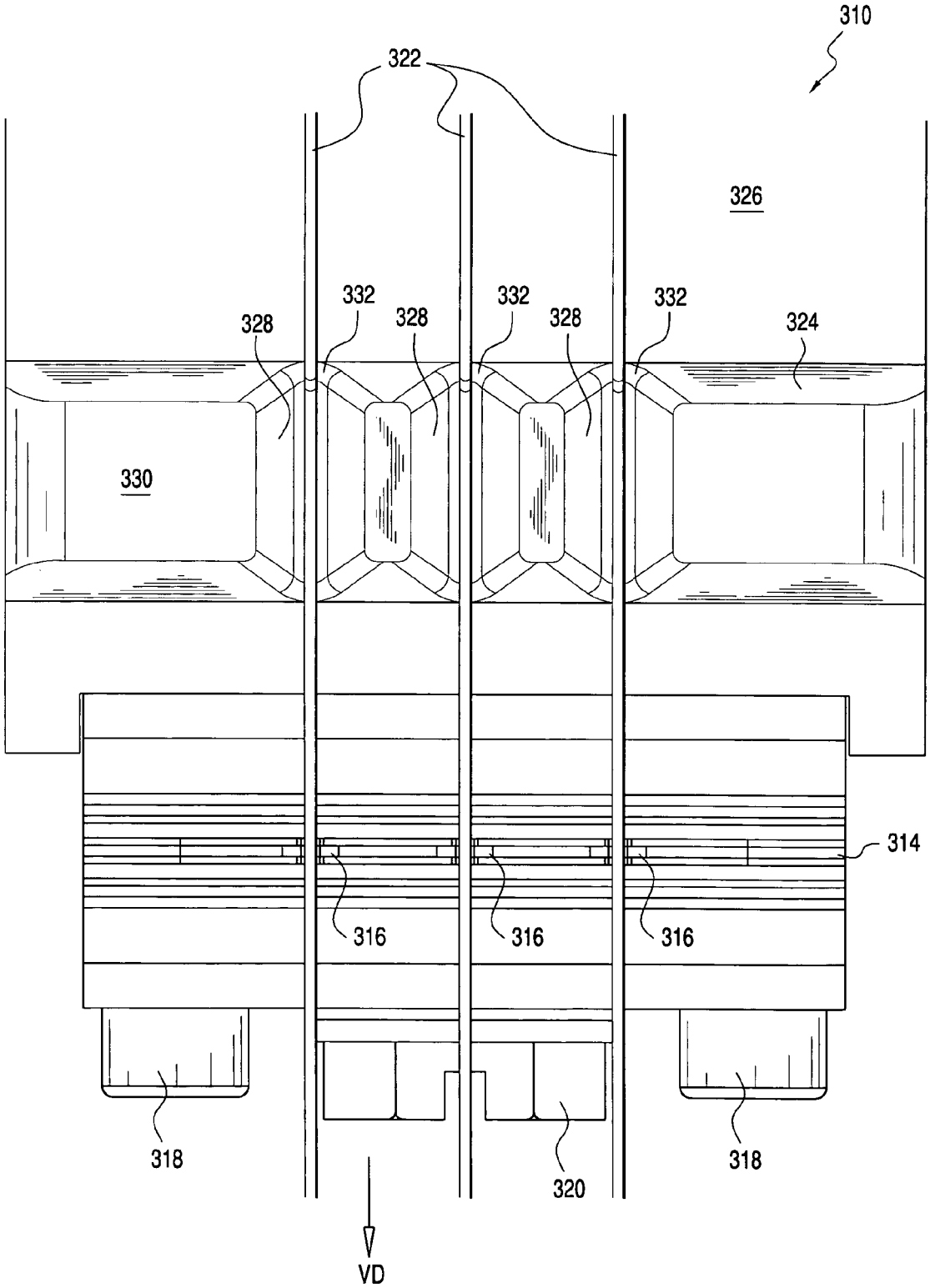
FIG. 3 is a front elevational view of the first embodiment of the new and improved strand guide system, as disclosed within FIG. 2, clearly illustrating the coplanar alignment defined between the strand guide slots and the hot melt adhesive dispensing nozzles so as to ensure the coplanar alignment of the elongated strands with respect to the hot melt adhesive dispensing nozzles whereby the hot melt adhesive material can in fact be properly applied to or coated upon each one of the elongated strands.

Referring now to the drawings, and more particularly to FIGS. 2 and 3 thereof, a first embodiment of a new and improved strand guide system, as constructed in accordance with the principles and teachings of the present invention, is disclosed and is generally indicated by the reference character 310. The strand guide system 310 is seen to comprise a module assembly 312 that controls the supply of the hot melt adhesive material and the control air or other gas to a hot melt adhesive material dispensing assembly 314, and it is seen that a plurality of hot melt adhesive material dispensing nozzles 316 are arranged or disposed within a horizontal array within the hot melt adhesive material dispensing assembly 314. A plurality of fasteners 318 fixedly secure together the plurality of components comprising the hot melt adhesive material dispensing assembly 314, and a hexagonal head fastener 320 fixedly secures the hot melt adhesive material dispensing assembly 314 to the bottom or undersurface portion of the module assembly 312. The hot melt adhesive material dispensing nozzles 316 are adapted to dispense and discharge hot melt adhesive material, which is to be deposited onto and coated upon a plurality of laterally spaced material strands 322 which are to be subsequently adhered to or upon one or more substrates, not shown, and it is to be appreciated that in accordance with this first embodiment of the new and improved strand guide system 310, the plurality of laterally spaced strands 322 are conveyed in the vertically downward direction as indicated by means of the arrow VD. More particularly, the plurality of laterally spaced strands 322 are adapted to be conveyed from a strand supply roll, not shown, to a product assembly station, also not shown, wherein the plurality of strands are to be interposed between and secured to woven and non-woven fabric substrates so as to fabricate, for example, baby diapers or similar products.

The hot melt adhesive material may be dispensed and discharged from the plurality of hot melt adhesive material dispensing nozzles 316 in accordance with, for example, any one of the techniques set forth within the aforenoted patents to Bolyard, Jr., Bolyard, Jr. et al., and Kwok, and in order to optimally achieve the deposition and coating of the hot melt adhesive material onto or upon the plurality of strands 322, it is critically important that each one of the plurality of strands 322 by aligned in a coplanar manner with respect to a respective one of the hot melt adhesive material dispensing nozzles 316. Consequently, in accordance with the particularly unique and novel structural features characteristic of the present invention, a strand guide implement or block 324 is fixedly mounted upon a vertically oriented mounting plate 326 which, in turn, is fixedly mounted upon the front face of the module assembly 312. The strand guide implement or block 324 is mounted upon the vertically oriented mounting plate 326 so as to be disposed at an elevational level which is above that of the horizontal array of hot melt adhesive material dispensing nozzles 316 whereby the strand guide implement or block 324 will effectively be disposed upstream of the hot melt adhesive material dispensing nozzles 316 as considered with respect to the vertically downward direction of conveyance VD of the plurality of elongated strands 322. It is seen that the strand guide implement or block 324 projects forwardly from the front face of the mounting plate 326, and it is further seen that a plurality of laterally spaced substantially V-shaped strand guide slots 328 are defined within the strand guide implement or block 324 so as to effectively extend rearwardly from a front face or surface 330 of the strand guide implement or block 324 whereby the apex portions 332 of the substantially V-shaped strand guide slots 328 are disposed in a recessed manner internally within the strand guide implement or block 324.

Continuing further, it can be additionally appreciated that each one of the apex portions 332 effectively forms a seat within or upon which each one of the plurality of elongated strands 322 is adapted to be disposed or seated. Accordingly, when each one of the plurality of elongated strands 322 is inserted into a respective one of the plurality of guide slots 328, the convergent side walls of each one of the substantially V-shaped guide slots 328 will effectively cause the respective one of the elongated strand 322 to be disposed or seated upon the apex seat portion 332, in view of the rearward biasing of the elongated strands 322 as determined, for example, by means of the disposition of the aforenoted strand supply roll, not shown, and the product assembly station, also not shown. In this manner, each one of the plurality of elongated strands 322 will effectively be laterally constrained or confined within its respective one of the substantially V-shaped guide slots 328. Still yet further, as may best be appreciated from FIG. 3, it is also seen that each one of the plurality of apex seat portions 332 of the plurality of substantially V-shaped strand guide slots 328 is respectively vertically aligned in a substantially coplanar manner with a respective one of the plurality of hot melt adhesive material dispensing nozzles 316. Accordingly, it is thereby ensured that each one of the elongated strands 322 will be conveyed within the common plane defined by means of respective ones of the apex seat portions 332 of the plurality of substantially V-shaped strand guide slots 328 and the plurality of hot melt adhesive material dispensing nozzles 316, and therefore, as hot melt adhesive material is dispensed and discharged from each one of the hot melt adhesive material dispensing nozzles 316, and deposited upon each one of the vertically oriented elongated strands 322, the elongated strands 322 will be properly coated with the hot melt adhesive material. It is lastly noted in connection with this first embodiment of the strand guide system 310 that the substantially V-shaped strand guide slots 328 are particularly useful in connection with elongated strands 322 having substantially circular or square-shaped cross-sectional configurations.

Figure 4:
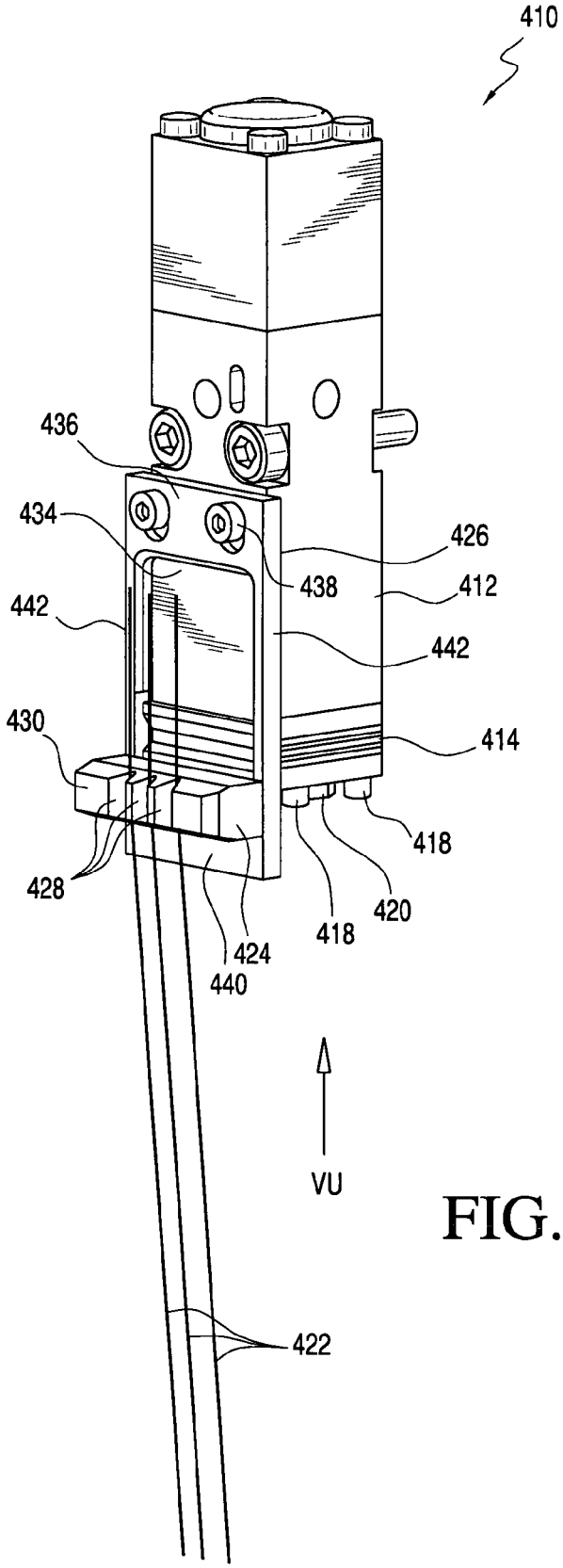
FIG. 4 is a perspective view, similar to that of FIG. 2, showing, however, a variation of the first embodiment of the new and improved strand guide system comprising the plurality of V-shaped strand guide slots defined within the strand guide implement or mechanism, wherein the strand guide implement or mechanism is likewise mounted upon the mounting plate which is again mounted upon the module assembly of the hot melt adhesive dispensing device or system, however, the plurality of V-shaped strand guide slots are disposed at an elevational level which is vertically below that of the horizontal array of hot melt adhesive dispensing nozzles so as to effectively guide or align those portions of the plurality of elongated strands which are disposed upstream of the hot melt adhesive dispensing nozzles in view of the fact that the plurality of elongated strands are being conveyed in the vertically upward direction.

With reference now being made to FIG. 4, a variation or modified embodiment of the new and improved strand guide system, comprising the plurality of V-shaped strand guide slots as defined within the strand guide implement or block, as illustrated within FIGS. 2 and 3, is disclosed and is generally indicated by means of the reference character 410. It is to be noted that, in view of the structural similarities characteristic of the modified embodiment of the new and improved strand guide system 410 and the aforenoted new and improved strand guide system 310, a complete description of the modified embodiment of the new and improved strand guide system 410 will be omitted herefrom for the sake of brevity, the detailed description being substantially confined to the structural differences which exist between the two strand guide systems 310,410. In addition, it is also noted that those structural components of the modified embodiment of the new and improved strand guide system 410, which correspond to the structural components of the aforenoted new and improved strand guide system 310, will be designated by corresponding reference characters except that they will be in the 400 series.

More particularly, it is firstly noted in connection with the modified embodiment of the new and improved strand guide system 410 that the direction of travel, or the direction of conveyance, for the plurality of elongated strands 422 is vertically upwardly as denoted by means of the arrow VU. Accordingly, in view of the fact that the strand guide implement or block 424, having the substantially V-shaped strand guide slots 428 defined therein, must be disposed upstream of the hot melt adhesive material dispensing assembly 414, as considered in accordance with the direction of conveyance VU of the plurality of elongated strands 422, wherein the hot melt adhesive material dispensing assembly 414 has the plurality of hot melt adhesive material dispensing nozzles, not illustrated within FIG. 4, defined therein, then the strand guide implement or block 424 must be disposed at an elevational level which is below that of the hot melt adhesive material dispensing assembly 414. Accordingly, it is seen, still further, that in lieu of a solid mounting plate, similar to the mounting plate 326 as illustrated within FIGS. 2 and 3, being fixedly mounted upon the module assembly 412, the mounting plate 426 which is fixedly mounted upon the front face or surface of the module assembly 412 is seen to comprise a four-sided framework type structure defining, in effect, a perimetral or peripheral structure wherein the central region 434 thereof is open.

More particularly, the mounting plate 426 is seen to comprise an upper marginal section 436, by means of which the mounting plate 426 is fixedly secured to the module assembly 412 by means of suitable fasteners 438, and a lower marginal section 440 upon which the strand guide implement or block 424 is fixedly mounted. A pair of oppositely disposed, vertically extending, laterally spaced marginal sections 442, 442 integrally interconnect the upper and lower marginal sections 436,440 of the mounting plate 426. As a result of the aforenoted structure comprising the mounting plate 426, it is apparent that the plurality of hot melt adhesive material dispensing nozzles, not illustrated, defined within the hot melt adhesive material dispensing assembly 414, can effectively dispense and discharge the hot melt adhesive material through the open central region 434 of the mounting plate 426 such that the hot melt adhesive material can be deposited onto the plurality of elongated strands 422 without encountering any interference with the mounting plate 426.

Figure 5:
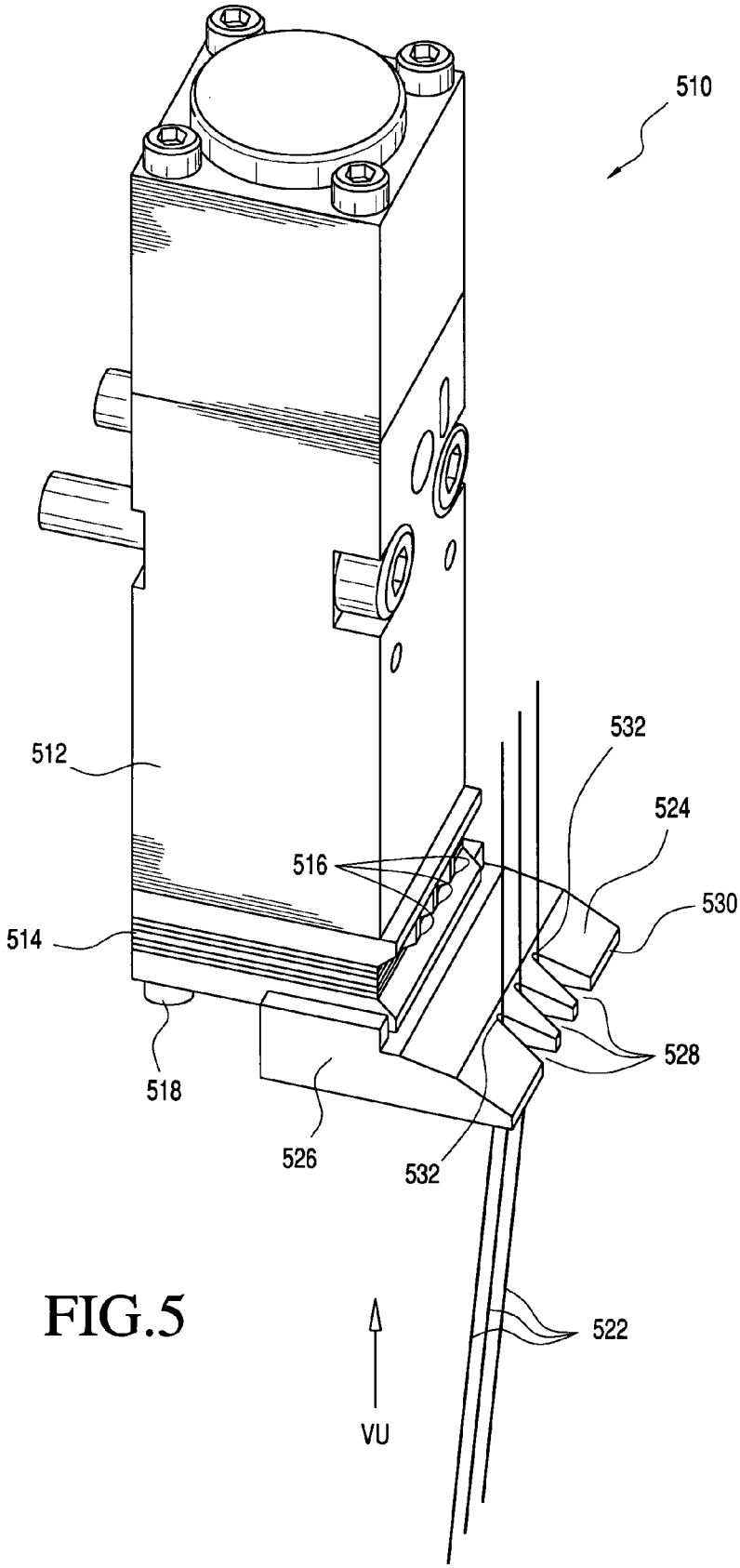
FIG. 5 is a perspective view, similar to that of FIG. 4, showing, however, a further variation of the first embodiment of the new and improved strand guide system comprising the plurality of V-shaped strand guide slots defined within the strand guide implement or mechanism, wherein, in lieu of the strand guide implement or mechanism being mounted upon a mounting plate which is mounted upon the module assembly of the hot melt adhesive dispensing device or system, the strand guide implement or mechanism is mounted upon the bottom or undersurface portion of the hot melt adhesive dispensing nozzle assembly such that the plurality of V-shaped strand guide slots are disposed at an elevational level which is again vertically below that of the horizontal array of hot melt adhesive dispensing nozzles so as to effectively guide or align those portions of the plurality of elongated strands which are disposed upstream of the hot melt adhesive dispensing nozzles in view of the fact that the plurality of elongated strands are likewise being conveyed in the vertically upward direction.

With reference now being made to FIG. 5, a further variation or modified embodiment of the new and improved strand guide system, comprising the plurality of V-shaped strand guide slots as defined within the strand guide implement or block, as illustrated within FIGS. 2–4, is disclosed and is generally indicated by means of the reference character 510. It is to be noted that, in view of the structural similarities characteristic of the modified embodiment of the new and improved strand guide system 510 and the aforenoted new and improved strand guide systems 310, 410, a complete description of the modified embodiment of the new and improved strand guide system 510 will be omitted herefrom for the sake of brevity, the detailed description being substantially confined to the structural differences which exist between the three strand guide systems 310, 410, 510. In addition, it is also noted that those structural components of the modified embodiment of the new and improved strand guide system 510, which correspond to the structural components of the aforenoted new and improved strand guide systems 310, 410, will be designated by corresponding reference characters except that they will be in the 500 series.

More particularly, it is firstly noted in connection with the modified embodiment of the new and improved strand guide system 510 that, as was the case with the modified embodiment as disclosed within FIG. 4, the direction of travel, or the direction of conveyance, for the plurality of elongated strands 522 is vertically upwardly as denoted by means of the arrow VU. Accordingly, in view of the fact that the strand guide implement or block 524, having the substantially V-shaped strand guide slots 528 defined therein, must be disposed upstream of the hot melt adhesive material dispensing assembly 514, as considered in accordance with the direction of conveyance VU of the plurality of elongated strands 522, wherein the hot melt adhesive material dispensing assembly 514 has the plurality of hot melt adhesive material dispensing nozzles 516 defined therein, then the strand guide implement or block 524 must be disposed at an elevational level which is below that of the hot melt adhesive material dispensing assembly 514. Accordingly, it is seen, still further, that in lieu of the mounting plates 326 or 426 being fixedly mounted upon the module assemblies 312, 412, as illustrated within FIGS. 2–4, the mounting plate 526 is fixedly mounted upon the bottom or undersurface portion of the hot melt adhesive material dispensing assembly 514 such that the mounting plate 526, and the strand guide implement or block 524 integrally mounted thereon, projects or extends forwardly.

Figure 6:
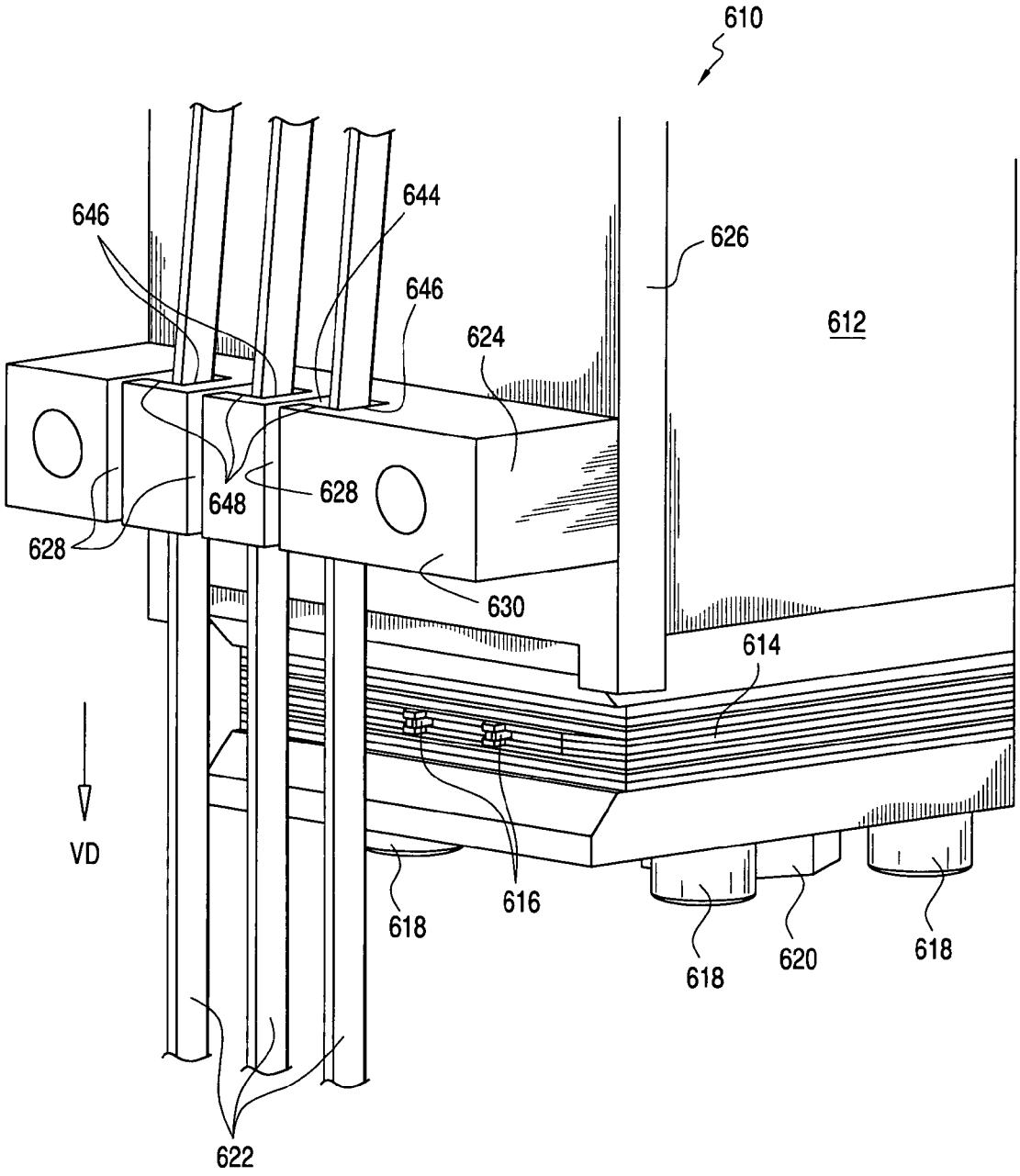
FIG. 6 is a perspective view, similar to that of FIG. 2, showing, however, a second embodiment of a new and improved strand guide system wherein a plurality of substantially L-shaped strand guide slots are defined within a strand guide implement or mechanism which is mounted upon a mounting plate that is mounted upon the module assembly of the hot melt adhesive dispensing device or system in such a manner that the plurality of substantially L-shaped strand guide slots are disposed at an elevational level which is vertically above that of the horizontal array of hot melt adhesive dispensing nozzles so as to effectively guide or align those portions of the plurality of elongated strands which are disposed upstream of the hot melt adhesive dispensing nozzles in view of the fact that the plurality of elongated strands are being conveyed in the vertically downward direction.
Figure 7:
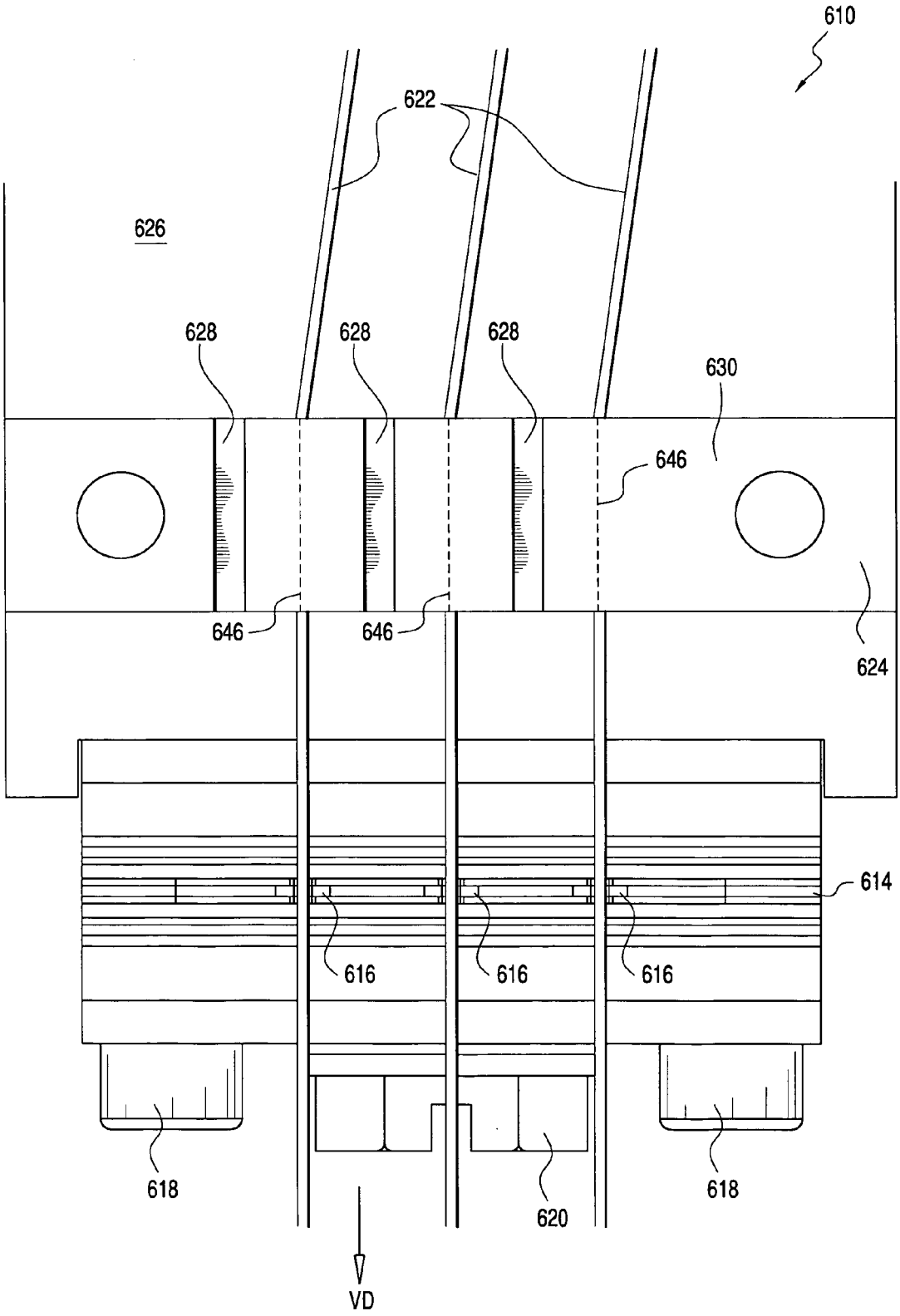
FIG. 7 is a front elevational view of the second embodiment of the new and improved strand guide system, as disclosed within FIG. 6, clearly illustrating the coplanar alignment defined between those portions of the substantially L-shaped strand guide slots upon which the elongated strands are effectively seated and the hot melt adhesive dispensing nozzles so as to ensure the coplanar alignment of the elongated strands with respect to the hot melt adhesive dispensing nozzles whereby the hot melt adhesive material can in fact be properly applied to or coated upon each one of the elongated strands.

With reference now being lastly made to FIGS. 6 and 7, a second embodiment of a new and improved strand guide system, likewise constructed in accordance with the teachings and principles of the present invention, is disclosed and is generally indicated by the reference character 610. It is to be noted that, in view of the structural similarities characteristic of the second embodiment of the new and improved strand guide system 610 of the present invention, as compared to the aforenoted new and improved strand guide systems 310, 410, 510, a complete description of the second embodiment of the new and improved strand guide system 610 of the present invention will be omitted herefrom for the sake of brevity, the detailed description being substantially confined to the structural differences which exist between the three strand guide systems 310, 410, 510, 610. In addition, it is also noted that those structural components of the second embodiment of the new and improved strand guide system 610 of the present invention, which correspond to the structural components of the aforenoted new and improved strand guide systems 310, 410, 510, will be designated by corresponding reference characters except that they will be in the 600 series.

More particularly, it is seen that the second embodiment of the new and improved strand guide system 610 of the present invention, as disclosed within FIGS. 6 and 7, is substantially similar to the first embodiment of the new and improved strand guide system 310 of the present invention, as disclosed within FIGS. 2 and 3, except for the particular structure characteristic of the strand guide implement or block 624 of the second embodiment strand guide system 610 as compared to the structure characteristic of the strand guide implement or block 324 of the first embodiment strand guide system 310. More specifically, as can best be appreciated from a comparison between the first and second embodiments of the present invention as illustrated within FIGS. 2 and 6, in lieu of the plurality of substantially V-shaped guide slots 328 which were defined within the strand guide implement or block 324, the strand guide implement or block 624 has a plurality of substantially L-shaped guide slots 628 defined therewithin. Continuing further, as a result of the definition of the plurality of substantially L-shaped guide slots 628 defined within the strand guide implement or block 624, a plurality of substantially L-shaped recesses 644, as defined by means of side and front wall members 646 and 648 which are disposed substantially perpendicular to each other, are defined internally within the strand guide implement or block 624. Accordingly, when each one of the elongated strands 622 is inserted into the substantially L-shaped guide slots 628 of the strand guide implement or block 624, and is biased into the conveyance position as a result of the upstream and downstream disposition of the strand supply roll, not shown, and the product assembly station, also not shown, the elongated strands 622 will effectively be disposed behind the front wall members 648 of the strand guide implement or block 624, and in addition will be seated upon the side wall members 646 of the strand guide implement or block 624.

It is to be further appreciated that the side wall members 646 of the strand guide implement or block 624 are effectively disposed in a coplanar manner with respect to a respective one of the plurality of hot melt adhesive material dispensing nozzles 616, and accordingly, still further, as may be particularly appreciated from FIG. 7, when the elongated strands 622 are in fact disposed at the aforenoted positions internally within the strand guide implement or block 624, the elongated strands 622 will be disposed within the planes defined by means of the side wall members 646 of the strand guide implement or block 624 and the respective ones of the plurality of hot melt adhesive material dispensing nozzles 616. In this manner, as hot melt adhesive material is dispensed and discharged from each one of the hot melt adhesive material dispensing nozzles 616, and deposited upon each one of the vertically oriented elongated strands 622, the elongated strands 622 will be properly coated with the hot melt adhesive material. Still yet further, it is lastly noted in connection with this second embodiment of the strand guide system 610 that the substantially L-shaped strand guide slots 628, and the L-shaped wall members 646,648, defined within the strand guide implement or block 624, are particularly useful in connection with the conveyance of elongated strands 622 having substantially rectangular-shaped cross-sectional configurations wherein each strand is defined by means of a pair of oppositely disposed faces comprising, in effect, the long legs of the rectangles, and a pair of oppositely disposed edges comprising, in effect, the short legs of the rectangles. As can best be appreciated from FIG. 6, when the elongated strands 622 are properly disposed within the strand guide implement or block 624, one of the faces, comprising one of the long legs of the rectangles, is disposed against and seated upon a respective one of the side wall members 646.

Thus, it may be seen that in accordance with the teachings and principles of the present invention, there has been provided a new and improved strand coating system wherein the strand guide implements or mechanisms serve to properly position and orient a plurality of elongated, parallel strands, which are being respectively transported or conveyed in front of a plurality of the material dispensing and coating nozzles, in such a manner that the plurality of elongated, parallel strands can assuredly be respectively disposed within the common plane which is effectively formed between the strand guide slots defined within the strand guide implements or blocks and the plurality of material dispensing and coating nozzles whereby the dispensed and discharged hot melt adhesive materials can be properly applied to or coated upon the elongated strands prior to the adherence of the elongated strands upon suitable substrates so as to, in turn, ensure the desirably secured adherence of the plurality of elongated strands upon the particular substrates when the elongated strands and the substrates are mated together. The plurality of strand guide slots may have substantially V-shaped cross-sectional configurations or substantially L-shaped cross-sectional configurations, the strand guide slots are particularly useful in connection with the conveyance of elongated strands having substantially circular, square, or rectangular cross-sectional configurations, and the strand guide implements or blocks, having the strand guide slots defined therein, can be mounted upon either the module assembly or the dispensing nozzle assembly so as to be disposed at elevational positions which are either vertically above or below the hot melt adhesive dispensing nozzles in order to accommodate vertically upward or vertically downward strand conveyance systems.

Obviously, many variations and modifications of the present invention are possible in light of the above teachings. It is therefore to be understood that within the scope of the appended claims, the present invention may be practiced otherwise than as specifically described herein.

The invention claimed is:

1. A strand guide system for guiding at least one elongated strand of material past a material dispensing apparatus such that material dispensed from said material dispensing apparatus can be properly coated upon the at least one elongated strand of material, comprising:

a material dispensing assembly having at least one material dispensing nozzle defined therein for dispensing a material to be coated upon at least one elongated strand of material as the at least one elongated strand of material is conveyed past said at least one material dispensing nozzle;

a module assembly for supplying the material to be dispensed to said material dispensing assembly and said at least one material dispensing nozzle defined within said material dispensing assembly;

means for mounting said material dispensing assembly upon said module assembly; and a strand guide block, having at least one elongated strand guide slot defined therein for guiding the at least one elongated strand of material as the at least one elongated strand of material is conveyed toward said at least one material dispensing nozzle defined within said material dispensing assembly, and mounted upon said module assembly at an elevational level which is vertically above the elevational level at which said material dispensing assembly is mounted upon said module assembly so as to dispose said at least one elongated strand guide slot, defined within said strand guide block, at a position upstream of said at least one material dispensing nozzle, defined within said material dispensing assembly, when the at least one elongated strand of material is being conveyed in a vertically downward direction, whereby said at least one elongated strand guide slot will be disposed in a coplanar manner with respect to said at least one material dispensing nozzle defined within said material dispensing assembly so as to define a common plane, with said at least one material dispensing nozzle defined within said material dispensing assembly, within which the at least one elongated strand of material will be disposed as the at least one elongated strand of material is conveyed past said at least one material dispensing nozzle defined within said material dispensing assembly so as to ensure that the material being dispensed from said at least one material dispensing nozzle defined within said material dispensing assembly will be properly deposited and coated upon the at least one elongated strand of material.

2. The strand guide system as set forth in claim 1, wherein:

said material dispensing assembly comprises means for dispensing hot melt adhesive materials.

3. The strand guide system as set forth in claim 1, further comprising:

a mounting plate fixedly mounted upon said module assembly, wherein said strand guide block is fixedly mounted upon said mounting plate.

4. The strand guide system as set forth in claim 1, wherein:

said at least one elongated strand guide slot, defined within said strand guide block, has a substantially V-shaped cross-sectional configuration.

5. The strand guide system as set forth in claim 1, wherein:

said at least one elongated strand guide slot, defined within said strand guide block, has a substantially L-shaped cross-sectional configuration.

6. The strand guide system as set forth in claim 1, wherein:

said strand guide block has a plurality of elongated strand guide slots defined therein; and said material dispensing assembly has a plurality of material dispensing nozzles defined therein for respectively defining with said plurality of elongated strand guide slots, defined within said strand guide block, a plurality of common planes along which a plurality elongated strands of material can be conveyed so as to have material, dispensed and discharged from said plurality of material dispensing nozzles, properly deposited and coated upon the plurality of elongated strands of material.

7. The strand guide system as set forth in claim 6, wherein:

said plurality of elongated strand guide slots, and said plurality of material dispensing nozzles, are disposed within horizontally disposed arrays.

8. A strand guide system for guiding at least one elongated strand of material past a material dispensing apparatus such that material dispensed from said material dispensing apparatus can be properly coated upon the at least one elongated strand of material, comprising:

a material dispensing assembly having at least one material dispensing nozzle defined therein for dispensing a material to be coated upon at least one elongated strand of material as the at least one elongated strand of material is conveyed past said at least one material dispensing nozzle;

a module assembly for supplying the material to be dispensed to said material dispensing assembly and said at least one material dispensing nozzle defined within said material dispensing assembly;

means for mounting said material dispensing assembly upon said module assembly; and a strand guide block, having at least one elongated strand guide slot defined therein for guiding the at least one elongated strand of material as the at least one elongated strand of material is conveyed toward said at least one material dispensing nozzle defined within said material dispensing assembly, and mounted upon said module assembly at an elevational level which is vertically below the elevational level at which said material dispensing assembly is mounted upon said module assembly so as to dispose said at least one elongated strand guide slot, defined within said strand guide block, at a position upstream of said at least one material dispensing nozzle, defined within said material dispensing assembly, when the at least one elongated strand of material is being conveyed in a vertically upward direction, whereby said at least one elongated strand guide slot will be disposed in a coplanar manner with respect to said at least one material dispensing nozzle defined within said material dispensing assembly so as to define a common plane, with said at least one material dispensing nozzle defined within said material dispensing assembly, within which the at least one elongated strand of material will be disposed as the at least one elongated strand of material is conveyed past said at least one material dispensing nozzle defined within said material dispensing assembly so as to ensure that the material being dispensed from said at least one material dispensing nozzle defined within said material dispensing assembly will be properly deposited and coated upon the at least one elongated strand of material.

9. The strand guide system as set forth in claim 8, further comprising:

a mounting plate fixedly mounted upon said module assembly and comprising a framework structure defining an open central area through which material from said at least one material dispensing nozzle, defined within said material dispensing assembly, can be dispensed and discharged for deposition upon the at least one elongated strand of material;

wherein said strand guide block is fixedly mounted upon a lower end portion of said open framework structure of said mounting plate.

10. The strand guide system as set forth in claim 8, wherein:

said at least one elongated strand guide slot, defined within said strand guide block, has a substantially V-shaped cross-sectional configuration.

11. The strand guide system as set forth in claim 8, wherein:

said strand guide block has a plurality of elongated strand guide slots defined therein; and said material dispensing assembly has a plurality of material dispensing nozzles defined therein for respectively defining with said plurality of elongated strand guide slots, defined within said strand guide block, a plurality of common planes along which a plurality elongated strands of material can be conveyed so as to have material, dispensed and discharged from said plurality of material dispensing nozzles, properly deposited and coated upon the plurality of elongated strands of material.

12. The strand guide system as set forth in claim 11, wherein:

said plurality of elongated strand guide slots, and said plurality of material dispensing nozzles, are disposed within horizontally disposed arrays.

13. The strand guide system as set forth in claim 8, wherein:

said material dispensing assembly comprises means for dispensing hot melt adhesive materials.

14. A strand guide system for guiding at least one elongated strand of material past a material dispensing apparatus such that material dispensed from said material dispensing apparatus can be properly coated upon the at least one elongated strand of material, comprising:

a material dispensing assembly having at least one material dispensing nozzle defined therein for dispensing a material to be coated upon at least one elongated strand of material as the at least one elongated strand of material is conveyed past said at least one material dispensing nozzle;

a module assembly for supplying the material to be dispensed to said material dispensing assembly and said at least one material dispensing nozzle defined within said material dispensing assembly;

means for mounting said material dispensing assembly upon said module assembly; and a strand guide block, having at least one elongated strand guide slot defined therein for guiding the at least one elongated strand of material as the at least one elongated strand of material is conveyed toward said at least one material dispensing nozzle defined within said material dispensing assembly, and mounted upon an undersurface portion of said material dispensing assembly so as to be disposed at an elevational level which is vertically below the elevational level at which said at least one material dispensing nozzle of said material dispensing assembly is located so as to dispose said at least one elongated strand guide slot, defined within said strand guide block, at a position upstream of said at least one material dispensing nozzle, defined within said material dispensing assembly, when the at least one elongated strand of material is being conveyed in a vertically upward direction, whereby said at least one elongated strand guide slot will be disposed in a coplanar manner with respect to said at least one material dispensing nozzle defined within said material dispensing assembly so as to define a common plane, with said at least one material dispensing nozzle defined within said material dispensing assembly, within which the at least one elongated strand of material will be disposed as the at least one elongated strand of material is conveyed past said at least one material dispensing nozzle defined within said material dispensing assembly so as to ensure that the material being dispensed from said at least one material dispensing nozzle defined within said material dispensing assembly will be properly deposited and coated upon the at least one elongated strand of material.

15. The strand guide system as set forth in claim 14, wherein:

said at least one elongated strand guide slot, defined within said strand guide block, has a substantially V-shaped cross-sectional configuration.

16. The strand guide system as set forth in claim 14, wherein:

said strand guide block has a plurality of elongated strand guide slots defined therein; and said material dispensing assembly has a plurality of material dispensing nozzles defined therein for respectively defining with said plurality of elongated strand guide slots, defined within said strand guide block, a plurality of common planes along which a plurality elongated strands of material can be conveyed so as to have material, dispensed and discharged from said plurality of material dispensing nozzles, properly deposited and coated upon the plurality of elongated strands of material.

17. The strand guide system as set forth in claim 16, wherein:

said plurality of elongated strand guide slots, and said plurality of material dispensing nozzles, are disposed within horizontally disposed arrays.

18. The strand guide system as set forth in claim 14, wherein:

said material dispensing assembly comprises means for dispensing hot melt adhesive materials.

* * * * *